United States Patent [19]

Edwards et al.

[11] 4,101,434

[45] Jul. 18, 1978

[54] MINERAL OIL COMPOSITIONS WITH AN ISOBUTYLENE POLYMER CONTAINING BOUND 2,6-DI-t-BUTYL PHENOL GROUPS

[75] Inventors: Douglas Cameron Edwards; John Walker, both of Sarnia, Canada

[73] Assignee: Polysar Limited, Sarnia, Canada

[21] Appl. No.: 789,236

[22] Filed: Apr. 20, 1977

[30] Foreign Application Priority Data

May 25, 1976 [CA] Canada ..... 253253

[51] Int. Cl.[2] ..... C10M 1/28

[52] U.S. Cl. ..... 252/52 R

[58] Field of Search ..... 252/52 R

[56] References Cited

U.S. PATENT DOCUMENTS

| | | | |
|---|---|---|---|
| 2,459,597 | 1/1949 | Stillson et al. | 252/52 R |
| 2,655,544 | 10/1953 | McNulty et al. | 252/42.7 |
| 3,255,255 | 6/1966 | Orloff | 252/52 R |
| 3,492,233 | 1/1970 | Hepplewhite et al. | 252/52 R |
| 3,582,514 | 6/1971 | Soldatos | 260/846 |
| 3,717,611 | 2/1973 | Baumer et al. | 252/52 R |
| 3,876,709 | 4/1975 | Lee et al. | 260/620 |
| 4,053,428 | 10/1977 | Pindar et al. | 252/52 R |

FOREIGN PATENT DOCUMENTS

| | | | |
|---|---|---|---|
| 1,212,462 | 11/1970 | United Kingdom | 252/52 R |

*Primary Examiner*—Delbert E. Gantz
*Assistant Examiner*—Joan Thierstein
*Attorney, Agent, or Firm*—Stevens, Davis, Miller & Mosher

[57] ABSTRACT

Mineral oil compositions of improved characteristics comprise a major proportion of a mineral oil and a minor proportion of an isobutylene polymer containing bound 2,6-di-t-butyl phenol groups.

3 Claims, No Drawings

MINERAL OIL COMPOSITIONS WITH AN ISOBUTYLENE POLYMER CONTAINING BOUND 2,6-DI-T-BUTYL PHENOL GROUPS

This invention relates to mineral oil compositions, particularly to mineral oil compositions of improved resistance to oxidation and having an improved viscosity index.

It is well known in the art that mineral oil compositions deteriorate during use under various service conditions. The deterioration can include oxidation of the oil or components of the oil composition, breakdown due to shearing action and the formation of deposits especially in internal combustion engines. Mineral oil compositions frequently contain viscosity index improvers. Certain of the prior art has taught additives which improve a single performance characteristic and additives which are multi-functional and which may improve two or more performance characteristics of the finished mineral oil composition. However, certain of these additives may have an adverse effect on one of the performance characteristics while enhancing the majority of the other performance characteristics - an example of this is that metal detergents tend to promote oxidation of the oil.

Additives previously used to improve the oxidation resistance of mineral oil compositions include bis(hydroxyphenyl) alkanes in combination with sulphurized diisobutylene, alkaline earth metal salts of sulphonic or phosphorous acid derivatives of aliphatic hydrocarbons in combination with anthranilic acid, the product obtained by the simultaneous polymerization and alkylation of heterocyclic N-vinyl monomers, and phosphosulphurized hydrocarbon - alkylene amino phenol reaction products.

It is the object of this invention to provide improved mineral oil compositions.

It is a further object of this invention to provide mineral oil compositions of improved resistance to oxidation and having improved viscosity index.

We have now discovered improved mineral oil compositions which comprise a major proportion of a mineral oil and a minor proportion of an isobutylene polymer containing bound at a terminal position 2,6-di-t-butyl phenol groups.

The mineral oil herein referred to can be any oil, such as a lubricating oil or a hydraulic fluid, with a viscosity within the range of the commonly available such oils. The oil is a refined or semi-refined paraffinic base oil, naphthenic base oil or mixed base oil. The oil may have a viscosity in the range of from about 100 to about 2500 SUS at 100° F, corresponding to the range of light to extra heavy oils. Blends of oils of various viscosities may also be used instead of a single oil. Generally the oil will have a viscosity index in the range of about 0 to about 100 and a flash point of above about 300° F.

The isobutylene polymers used in this invention are polymers containing at least 75 weight percent and up to 100 weight percent of isobutylene forming the polymeric backbone. Suitable comonomers include isopentene, hexene, butene-1, butadiene, isoprene, styrene and $\alpha$-methyl styrene. Preferred isobutylene polymers include isobutylene homopolymer, isobutylene-butene-1 copolymers and isobutylenestyrene copolymers. The majority of the isobutylene polymer contains, in a single essentially terminal position of the polymeric chain, a 2,6-di-tertiary-butyl phenol group attached to the polymeric chain at the 4-position of the aromatic phenol ring. The amount of 2,6-di-t-butyl phenol present in the isobutylene polymer depends on the molecular weight of the polymer and is within the range of about 1 to about 20 weight percent, expressed as 2,6-di-t-butyl phenol, per se. A preferred range for the amount of 2,6-di-t-butyl phenol groups is from 2 to 15 weight percent. The molecular weight of the isobutylene polymer may be quantified as the intrinsic viscosity [$\eta$] as determined in toluene at 30° C or as the bulk viscosity determined with a Brookfield viscometer at 25° C. The molecular weight range of suitable isobutylene polymers is represented by an intrinsic viscosity of from 0.05 to 0.5 dl/g, preferably from 0.07 to 0.3 dl/g, or as a Brookfield viscosity of from 300 to about 60,000 poise, preferably from 2000 to 30,000 poise.

The mineral oil compositions of the invention comprise a major proportion of a mineral oil and a minor proportion of the isobutylene polymer hereinabove defined. The amount of isobutylene polymer in the mineral oil composition is preferably from about 1 to about 20 weight percent of the total mineral oil composition.

The mineral oil composition may also contain other additives known in the art, such as detergent additives, sludge dispersants, additional antioxidants, pour point depressants, additional viscosity index improvers, etc.

The isobutylene polymers used in this invention may be made by the cationic polymerization of isobutylene, optionally in combination with suitable comonomers, in the presence of 2,6-di-t-butyl phenol. The polymerization may be in the presence of suitable solvents or diluents such as n-butane, n-pentane, n-hexane, methylene chloride, ethylene chloride, methyl chloride and ethyl chloride, the solvent or diluent forming up to 80 percent by volume of the polymerization mixture. Suitable catalysts include aluminum chloride, aluminum bromide, boron trifluoride, boron trifluoride etherate, aluminum ethyl dichloride, aluminum butyl dichloride, aluminum diethyl chloride plus a proton source and aluminum dibutyl chloride plus a proton source. Polymerization temperatures are suitably from about 0° to about −100° C. The polymer may be recovered by conventional means for the recovery of liquid or semi-liquid polymers including flashing unreacted monomer and solvent such as by contact with hot water or by heating under reduced pressure or by precipitating the polymer in an alcoholic medium. The polymer is dried of residual materials by conventional methods. The quantity of bound 2,6-di-t-butyl phenol groups is determined by U.V. analysis, the absorption band at 277nm, which is due to the substituted phenol structure, being measured with no correction being made for styrene if present in the polymer, the result being expressed as weight of 2,6-di-t-butyl phenol per 100 grams of polymeric product.

The improved mineral oil compositions were evaluated using standard test procedures. The kinematic viscosity of the mineral oil composition was determined according to ASTM D445-74 at temperatures of 100° F and 210° F, the results being reported in centistokes. The viscosity index was determined according to procedure ASTM D2270-74, using the Tables provided therein for viscosity data determined at 100° F and 210° F. The oxidation of the mineral oil composition is determined in accordance with Canadian Government Specification Board procedure 3-GP-0, Method 38.4, wherein 100 ml of oil is placed in a glass tube, five clean metal plates are immersed in the oil and air is passed through the oil at 5 liters per hour, for 168 hours, at a temperature of 250° F. The acid number of the oil is measured before and after this treatment, the measurement being according to procedure ASTM D974-64. The metal surfaces (copper, magnesium, aluminum, steel and cadmium-plated steel) are studied for pitting, corrosion and discoloration. The diesel injection shear stability is determined in accordance with Canadian Government Specification Board procedure 3-GP-0, Method 39.30, wherein the mineral oil composition is pumped 20 times through a specified Deckel slant-ended nozzle having an orifice of 0.006 inches. The viscosity of the mineral oil composition is measured before and after the test, using procedure ASTM D445-74 at 100° F.

The invention is illustrated by the following examples which are not intended to limit the scope of the invention.

EXAMPLE 1

Isobutylene polymers containing terminal 2,6-di-tertiary-butyl phenol groups were prepared according to the following procedure.

32-ounce glass polymerization bottles were dried by heating in an oven at 100° C overnight and were then cooled to room temperature under a stream of dry nitrogen. The amount of 2,6-di-t-butyl phenol, shown in Table 1, was transferred to each bottle and the bottle was then capped with a crown cap. The amount of solvent (dry hexane or methyl chloride) was then added followed by the addition of styrene, when used. The bottle was placed in a dry ice-acetone bath and allowed to cool. Isobutylene was then charged and the bottle allowed to cool. The catalyst (aluminum chloride in methylene chloride as a 0.4 weight % solution or ethyl aluminum dichloride in n-hexane as a 20 weight % solution) was then added and the contents of the bottle were shaken. After 30 minutes, the contents of the bottle were poured slowly into about one liter of ethanol and the liquid polymeric material was separated off, washed with two further quantities of ethanol and dried under vacuum at 80° C. The details are shown in Table 1 together with the results for the bound 2,6-di-t-butyl phenol groups, the intrinsic viscosity and the Brookfield viscosity.

Table 1

| Experiment No. | Isobutylene | Styrene | Methyl Chloride | Di-t-butyl Phenol | $AlEtCl_2$ | $AlCl_3$ |
|---|---|---|---|---|---|---|
| | grams | grams | grams | grams | grams | grams |
| I | 60 | — | 184 | 10 | 0.6 | — |
| II | 59.6 | — | 132** | 8 | 1.6 | — |
| III | 50 | 10 | 184 | 8 | 1.6 | — |
| IV | 55 | 5 | 184 | 8 | 1.6 | — |
| V | 55 | 5 | 184 | 8 | 1.6 | — |
| VI | 60 | — | 184 | 8 | 0.8 | — |
| VII | 50 | 10 | 184 | 8 | 0.8 | — |
| VIII | 60 | — | 184 | 4 | 0.8 | — |
| IX | 60 | — | 184 | 8 | 0.8 | — |
| X | 60 | — | 184 | 8 | — | 0.12 |
| Control* | 60 | — | 184 | — | 0.8 | — |

*3.5 grams diisobutylene added to bottle before polymerization.
**n-hexane instead of methyl chloride.

Polymer Characteristics

| Experiment No. | I | II | III | IV | V | VI | VII | VIII | IX | X | Control |
|---|---|---|---|---|---|---|---|---|---|---|---|
| Bound di-t-butyl phenol (wt.%) | 13.2 | 12.1 | 9.2 | 11.7 | 11.7 | 5.7 | 5.1 | 1.7 | 3.5 | 6.6 | 0 |
| [η] (dl/g) | — | 0.10 | 0.09 | 0.08 | 0.08 | 0.12 | 0.08 | 0.11 | 0.09 | 0.16 | 0.09 |
| Viscosity (poise) | 2100 | 4840 | 2860 | 4700 | 4700 | 8500 | 3640 | 3150 | 2180 | 12,000 | 660 |

EXAMPLE 2

Mineral oil compositions were prepared by blending the isobutylene polymers of Example 1 with a 250 Neutral mineral oil base stock. The composition of these blends and the viscosity and acid number characteristics are shown in Table 2. The presence of the isobutylene polymer in the mineral oil compositions improves the viscosity index and causes no increase in the acid number compared to the base stock.

In Table 3 are recorded the results of the oxidation tests on these mineral oil compositions. The change in acid number is reduced, for certain experiments very markedly, by the presence of the isobutylene polymers containing the bound 2,6-di-t-butyl phenol groups. Note that Control-1 contains no isobutylene polymer and that Control-2 contains an isobutylene polymer having no 2,6-di-t-butyl phenol groups. The change in viscosity is also shown, generally, to be reduced by the presence of the isobutylene polymer.

Also shown in Table 3 are the results of the shear stability test, the viscosity being that after completion of the diesel injection shear stability test and the percent change in viscosity being in comparison with the original viscosity. The test results generally show relatively small changes in viscosity when the isobutylene polymers are present. A commercially available oil showed a 10.8% decrease in viscosity under the same test conditions.

Table 2

| Experiment No. | Weight of Oil Base Stock | Polymer Expt. # | Weight of Polymer | Viscosity (centi-stokes) | Viscosity (centi-stokes) | Viscosity Index | Total Acid No. |
|---|---|---|---|---|---|---|---|
| | (g) | of Ex. 1 | (g) | at 100° F | at 210° F | | |
| Control-1 | 100 | — | 0 | 57.28 | 7.32 | 96 | 0.03 |
| A | 95 | I | 5 | 88.15 | 10.42 | 110 | 0.02 |
| B | 95 | II | 5 | 91.32 | 10.56 | 108 | 0.04 |
| C | 95 | III | 5 | 83.89 | 9.78 | 104 | 0.02 |
| D | 97.5 | IV | 2.5 | 68.74 | 8.39 | 100 | 0.02 |
| E | 92.5 | V | 7.5 | 99.75 | 11.05 | 105 | 0.03 |
| F | 92.5 | VI | 7.5 | 124.19 | 13.51 | 114 | 0.02 |

Table 2-continued

| Experiment No. | Weight of Oil Base Stock | Polymer Expt. # | Weight of Polymer | Viscosity (centi-stokes) | Viscosity (centi-stokes) | Viscosity Index | Total Acid No. |
|---|---|---|---|---|---|---|---|
| G | 95 | VII | 5 | 82.51 | 9.65 | 104 | 0.02 |
| H | 95 | VIII | 5 | 91.88 | 10.69 | 109 | 0.01 |
| I | 95 | IX | 5 | 87.08 | 10.20 | 107 | 0.02 |
| J | 95 | X | 5 | 113.29 | 12.79 | 116 | 0.02 |
| Control-2 | 95 | Control | 5 | 83.71 | 10.01 | 109 | 0.01 |

Table 3

| | | Oxidation Tests | | | Shear Stability | |
|---|---|---|---|---|---|---|
| Experiment No. | Viscosity (centi-stokes) at 100° F | Change in Viscosity % | Total Acid No. | Change in Acid No. | Viscosity (centi-stokes) at 100° F | Change in Viscosity % |
| Control-1 | 59.37 | +3.65 | 0.78 | +0.75 | 57.92 | +1.1 |
| A | 90.54 | +2.7 | 0.04 | +0.02 | 86.58 | −1.8 |
| B | 93.21 | +2.5 | 0.10 | +0.06 | 89.01 | −2.5 |
| C | 85.90 | +2.4 | 0.37 | +0.35 | 83.35 | −0.7 |
| D | 70.95 | +3.2 | 0.45 | +0.43 | 68.70 | −0.1 |
| E | 104.73 | +5.0 | 0.46 | +0.43 | 98.44 | −1.3 |
| F | 127.20 | +2.4 | 0.08 | +0.06 | 121.60 | −2.1 |
| G | 84.05 | +1.9 | 0.16 | +0.14 | 82.91 | +0.5 |
| H | 95.85 | +4.3 | 0.39 | +0.38 | 88.65 | −3.5 |
| I | 90.38 | +3.8 | 0.27 | +0.25 | 86.00 | −1.2 |
| J | 115.86 | +2.3 | 0.06 | +0.04 | 108.42 | −4.3 |
| Control-2 | 87.93 | +5.0 | 0.56 | +0.55 | 81.00 | −3.2 |

What is claimed is:

1. Improved mineral oil compositions comprising a major proportion of a mineral oil and from about 1 to about 20 weight percent of the total mineral oil composition of an isobutylene polymer containing bound at a terminal position from about 1 to about 20 weight percent of 2,6-di-t-butyl phenol groups attached to the isobutylene polymer at the 4-position of the aromatic phenol ring, the isobutylene polymer having an intrinsic viscosity as determined in toluene at 30° C of from 0.05 to 0.5 dl/g.

2. The composition of claim 1 wherein the isobutylene polymer has an intrinsic viscosity as determined in toluene at 30° C of from 0.07 to 0.3 dl/g.

3. The composition of claim 2 in which the isobutylene polymer contains from 2 to 15 weight percent of 2,6-di-t-butyl phenol groups.

* * * * *